US006386404B1

(12) United States Patent
Auer

(10) Patent No.: US 6,386,404 B1
(45) Date of Patent: May 14, 2002

(54) AUTOMATIC CLOSURE FOR ELASTICALLY DEFORMABLE CONTAINERS

(75) Inventor: Günter Auer, Villingen-Schwenningen (DE)

(73) Assignee: Megaplast GmbH & Co. KG (DE)

( * ) Notice: Subject to any disclaimer, the term of this patent is extended or adjusted under 35 U.S.C. 154(b) by 0 days.

(21) Appl. No.: 09/920,079

(22) Filed: Aug. 1, 2001

(30) Foreign Application Priority Data

Aug. 2, 2000 (DE) ..... 200 13 287

(51) Int. Cl.[7] ..... B67D 3/00

(52) U.S. Cl. ..... 222/484; 222/212; 222/482; 222/494; 222/548; 222/553

(58) Field of Search ..... 222/484, 482, 222/494, 548, 553, 555, 496, 212, 213

(56) References Cited

U.S. PATENT DOCUMENTS

| | | | | | |
|---|---|---|---|---|---|
| 2,711,271 | A | * | 6/1955 | Schlicksupp | 222/493 |
| 4,061,254 | A | * | 12/1977 | Nilson | 222/494 |
| 4,226,342 | A | * | 10/1980 | Laauwe | 222/494 |
| 4,474,314 | A | * | 10/1984 | Roggenburg, Jr. | 222/494 |
| 4,699,300 | A | * | 10/1987 | Blake | 222/494 |
| 4,739,906 | A | * | 4/1988 | LoTurco | 222/153 |
| 4,747,518 | A | * | 5/1988 | Laauwe | 222/153 |
| 4,877,624 | A | * | 10/1989 | Floyd et al. | 426/241 |
| 4,946,076 | A | * | 8/1990 | Hackmann et al. | 222/207 |
| 5,255,826 | A | * | 10/1993 | Ranalletta et al. | 222/209 |
| 5,692,651 | A | * | 12/1997 | Fuchs | 222/494 |
| 6,298,554 | B1 | * | 10/2001 | Fuchs | 29/890.127 |

FOREIGN PATENT DOCUMENTS

| | | |
|---|---|---|
| DE | 43 29 808 | 3/1995 |
| DE | 195 03 879 | 8/1996 |
| DE | 696 07 263 | 11/2000 |
| WO | WO 99/07614 | 2/1999 |
| WO | WO 00/07900 | 2/2000 |

OTHER PUBLICATIONS

DE 43 29 808 Abstract, Mar. 9, 1995, Germany.

DE 195 03 879 Abstract, Aug. 8, 1996, Germany.

DE 696 07 263 Abstract, Nov. 2, 2000, Germany.

* cited by examiner

*Primary Examiner*—Kenneth Bomberg
*Assistant Examiner*—Frederick C. Nicolas
(74) *Attorney, Agent, or Firm*—McGlew and Tuttle, P.C.

(57) ABSTRACT

An automatic closure for elastically deformable, tube-like or bottle-like containers of pasty or liquid media has a dispensing opening (5), which is arranged in a front wall (3) of a hood cover and can be closed by an axially movable closing member (8). The closing member (8) is part of an elastic membrane wall (9) of an elastic, hood-like hollow body (10). This hollow body surrounds a ring wall (12) of a chamber (15), which is closed by a bottom (13), through which the medium flows and is provided with a ventilating channel. To make possible a sufficient suction ventilation of the container in a simple manner, the inner ring wall is surrounded by a second ring wall, which forms an annular groove (17) with the inner ring wall (12). The annular groove (17) has at least one axial ventilating opening (30, 31), which connects the ventilating channel (28,29) to the hollow space (27) surrounded by the second ring wall (16). The cylindrical wall section (11) of the hollow body (10) is provided with an elastic lip (32,33,34,35), which separates the ventilating opening (30,31) having the function of a one-way valve from the hollow space (27).

9 Claims, 3 Drawing Sheets

AUTOMATIC CLOSURE FOR ELASTICALLY DEFORMABLE CONTAINERS

FIELD OF THE INVENTION

The present invention pertains to an automatic closure for elastically deformable, tube-like or bottle-like containers having a dispensing neck for pasty or liquid media with a dispensing opening, which is arranged in a front wall of a hood cover and can be closed from the inside by a stopper-like closing member movable in the axial direction of the dispensing opening, wherein the hood cover is arranged on a housing that can be attached to the dispensing neck and wherein the closing member is part of an elastic membrane wall of a hood-like hollow body, which consists of an elastic material as a whole and surrounds with an at least approximately cylindrical wall section an inner ring wall of a chamber, which is closed by a bottom, is arranged within a hollow space of the housing through which the medium flows and is connected to the environment by at least one ventilating channel, which is arranged in a radial web and connects the inner ring wall to the housing.

BACKGROUND OF THE INVENTION

A closure of this type has already been known from WO 99/07614 (PCT/GB 98/02326).

In the case of such closures, the dispensing of the medium is brought about by generating an overpressure inside the container by applying pressure to the side walls of the container, which said overpressure also affects the membrane wall and causes same to remove the closing member from the dispensing opening of the hood cover in order for the medium to be able to be dispensed through this dispensing opening. When the dispensing operation is terminated and the manual pressure on the wall of the housing is no longer present, the wall of the housing shall again return to its original shape due to its elastic restoring forces. However, the volume of the interior space is again increased as a result at the same time, so that outside air must flow into the interior space in order for an equalization of the atmospheric pressure to be able to take place.

Depending on the nature of the medium forming the contents of the container and/or of the plastic restoring forces of the container wall, it may be necessary to additionally ventilate the interior space of the container, which is filled with the medium, or of the closure after a dispensing operation to enable the container or its indented side walls to be able to rapidly return to the original shape.

To take this circumstance into account, an additional one-way valve is provided for ventilating the interior space of the container in a closure similar to the closure of this type, which is described in WO 00/07900 (PCT/GB 99/02522). This one-way valve comprises a separate, axially movable closing member and a passage opening, which is arranged in the bottom of the chamber formed by the inner ring wall. The closing member comprises a ring-shaped closing surface, which lies sealingly on an opposing surface of the passage opening of the bottom when a corresponding pressure is applied to the closing member, which occurs, e.g., during the deformation of the container during a dispensing operation.

This axially movable closing member is guided by finger-like holders and its axial movement is limited. It consists of a dimensionally stable, i.e., non-elastic material and can be moved only as a whole. It is always completely surrounded by the medium to be dispensed. Reliability of the function may be jeopardized at certain viscosities of the medium.

When only small amounts of the medium reach the valve seating surface or via this surface the interior space of the chamber at the end or at the beginning of a dispensing operation, this may lead to a loss of the ability of the entire closure to function.

In addition, the closing member of this one-way valve is an additional component, which is to be manufactured separately and must be mounted later and it therefore represents an additional cost factor in the manufacturing costs.

SUMMARY AND OBJECTS OF THE INVENTION

The basic object of the present invention is to provide a closure of the type mentioned in the introduction, in which the suction ventilation of the container, which is necessary at weak restoring forces of the elastic container walls, is achieved by means of a valve arrangement, which is inexpensive in terms of both manufacture and assembly and which also ensures at the same time that the medium in the container or in the housing of the closure can never enter the chamber or a ventilating channel under any circumstances.

This object is accomplished according to the present invention by the inner ring wall being surrounded by a second ring wall, which forms an annular groove with the inner ring wall with the annular groove having at least one axial ventilating opening, which connects the ventilating channel to the hollow space surrounded by the second ring wall. The cylindrical wall section of the hood-like hollow body is provided with an elastic lip, which separates the ventilating opening having the function of a one-way valve from the hollow space.

The present invention creates an automatic closure of this type, which also makes possible the ventilation of the interior space of the container and of the interior space of the closure body, but the one-way valve of which does not require an additional component, on the one hand, and does not cause additional assembly costs, and in which the reliability of function is guaranteed at a substantially greater extent than in the prior-art one-way valve, because the elastic lip is lifted off from its opposing surface only partially and minimally when atmospheric air is indeed flowing through the opening closed by the lip into the interior space.

The lip may be designed as a circular ring lip and may lie sealingly on a bottom surface of the annular groove in both the inoperative state and under overpressure and allows air to flow into the hollow space under vacuum in the hollow space. The lip may also be designed as a ring lip projecting to the outside in a truncated cone-shaped manner and may lie all around sealingly on the second ring wall in both the inoperative state and under overpressure in the hollow space and allows air to flow into the hollow space under vacuum in the hollow space.

The second ring wall may have, axially outside the ring lip, radial perforations, via which the hollow space surrounded by it is in connection with a ring chamber, which surrounds the second ring wall and which is in turn in connection with the interior space of a connection pipe that can be attached to the dispensing neck of the container and, in the mounted state, with the dispensing neck of the container.

A concentric arrangement in relation to the two ring walls, which are concentric to one another, the hood cover is mounted on the housing rotatably around the common axis. The hood cover has a ring-shaped closing wall, which sealingly surrounds the second ring wall and has perforations, which can be brought into an overlapping position with the perforations of the second ring wall by rotating the hood cover in order to connect the ring chamber with the hollow space within the second ring wall or to separate the ring chamber from the hollow space as desired.

The angle of rotation of the hood cover is limited by the correspondingly arranged rotation limiters to a value (β) that is greater than the opening angle (α) of the perforation of the second ring wall, which is the largest perforation in the circumferential direction.

The hood cover is provided with a sealing ring lying sealingly on the inner surface of a cylindrical housing wall of the housing.

The hood cover is fastened to the housing by means of a cylindrical coupling wall or by means of ring sector-like coupling wall elements, which have radially inner locking cams and extend with these under a radially projecting ring collar of the housing.

The present invention will be explained in greater detail below on the basis of the drawings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention is illustrated.

DESCRIPTION OF THE PREFERRED EMBODIMENTS

Figure 1:
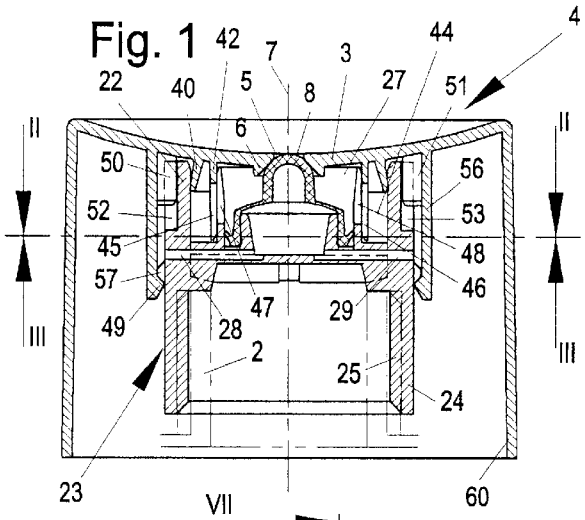
FIG. 1 is a sectional view according to line I—I in FIG. 2 of an automatically closing closure for elastically deformable, tube-like or bottle-like containers with a dispensing neck.
Figure 6:
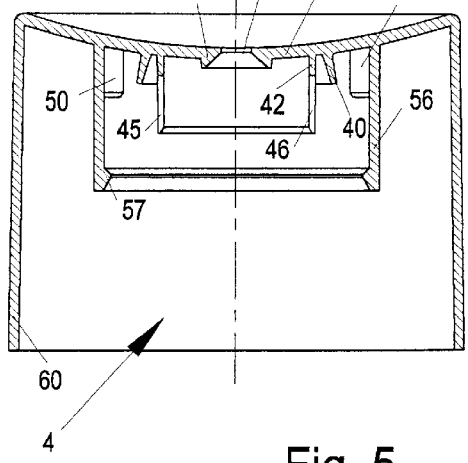
FIG. 6 is a sectional view according to FIG. 1 showing the hood cover as an individual part.

Referring to the drawings in particular, the automatic closure 1 can be attached to elastically deformable, tube-like or bottle-like containers (not shown) of paste-like or liquid media, which have a dispensing neck 2 indicated by phantom lines.

A dispensing opening 5 has a conical collar 6 on the inner side of the front wall 3. The dispensing opening 5 is arranged centrally in a front wall 3 of a hood cover 4.

Figure 7:
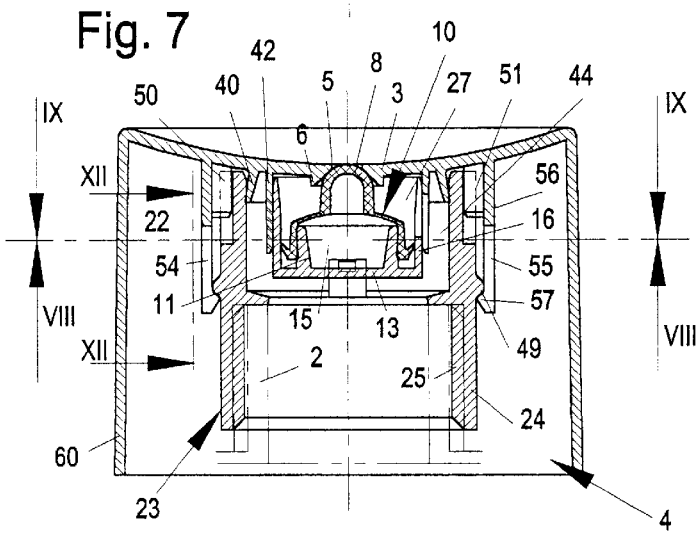
FIG. 7 is a sectional view VII—VII from FIG. 2, which is rotated by 90° compared with FIG. 1.
Figure 11:
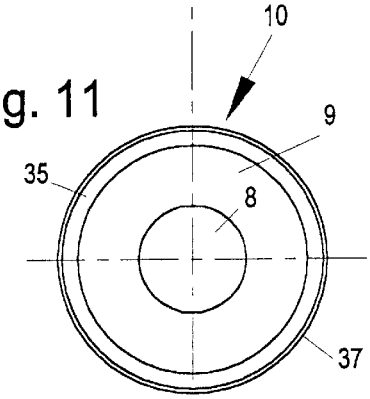
FIG. 11 is a view XI from FIG. 10.

This dispensing opening 5 can be closed by an elastic, stopper-like closing member 8, which is movable axially in the direction of the axis 7 of the dispensing opening 5. This closing member 8, designed as a hollow nipple, is a one-piece part of an elastic radial membrane wall 9 of a hood-like hollow body 10 consisting of an elastic material as a whole. This hollow body 10 has a cylindrical wall section 11, which is made in one piece with the membrane wall 9 (FIG. 7) and sealingly surrounds a dimensionally stable inner cylindrical ring wall 12 in the mounted state. This inner ring wall 12 is provided with a closed bottom 13 and forms the radial limitation of a chamber 15, whose upper limitation is formed by the membrane wall 9 with the closing member 8.

This inner ring wall 12 is surrounded by a second ring wall 16, which forms an annular groove 17 with the inner ring wall 12 and axially nearly extends to the front wall 3 of the hood cover 4.

Via a total of four radial webs 18, 19, 20 and 21, the second ring wall 16 is in a one-piece connection with an outer cylindrical ring wall 22 of a housing 23, which is hollow cylindrical as a whole and whose lower part 24 is designed as a screw socket with an internal thread 25 and is thus suitable for being screwed on a dispensing neck 2 of a bottle or tube-like container. As is known per se, it is also possible to provide other fastening means, e.g., snap-in devices or locking devices instead of the screw thread being provided here.

Figure 13:
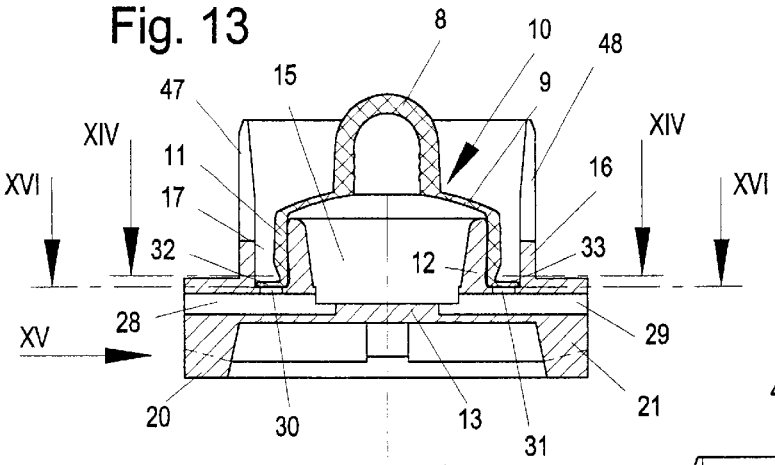
FIG. 13 is an enlarged sectional view showing the inner part of the housing.
Figure 14:
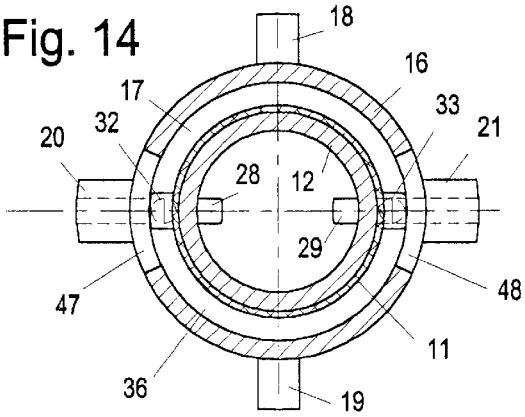
FIG. 14 is a sectional view according to line XIV—XIV from FIG. 13.
Figure 15:
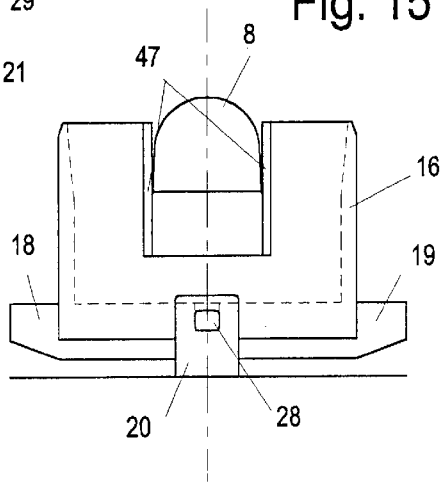
FIG. 15 is a side view XV from FIG. 13.
Figure 16:
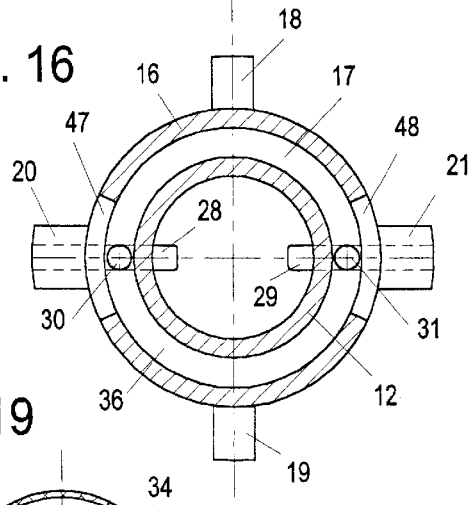
FIG. 16 is a sectional view according to line XVI—XVI from FIG. 13.

The radial webs 18, 19, 20 and 21 are arranged above the internal thread 25 approximately at half height of the housing 23. Ventilating channels 28 and 29, which connect the chamber 15 to the atmosphere, are located in the two radial webs 20 and 21, which are somewhat broader and higher than the radial webs 18 and 19. In addition, these ventilating channels 28 and 29 are in connection with the annular groove 17 through axial ventilating openings 30 and 31. These ventilating openings 30 and 31 can be recognized most clearly from FIGS. 13 and 16.

Figure 4:
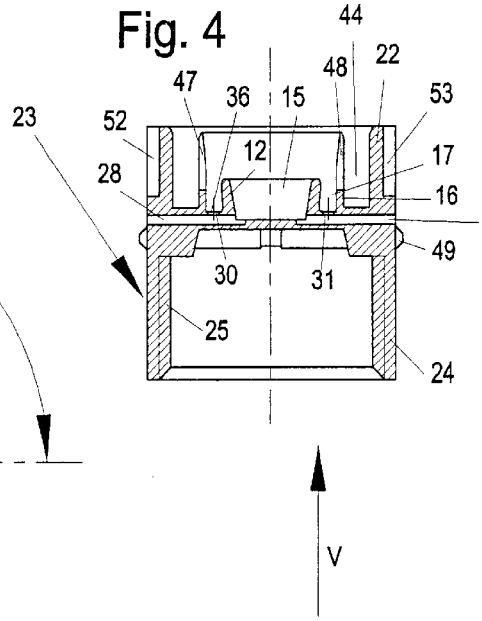
FIG. 4 is a sectional view according to FIG. 1 showing the housing as an individual part.
Figure 17:
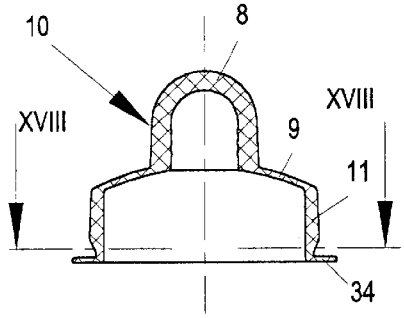
FIG. 17 is a sectional view showing the hollow body from FIG. 13, which comprises the closing member and the elastic membrane wall as well as the lip, as an individual part.
Figure 18:
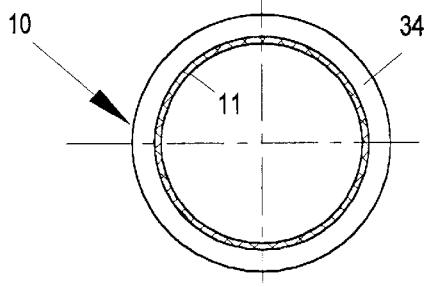
FIG. 18 is a sectional view XVIII—XVIII from FIG. 17.
Figure 19:
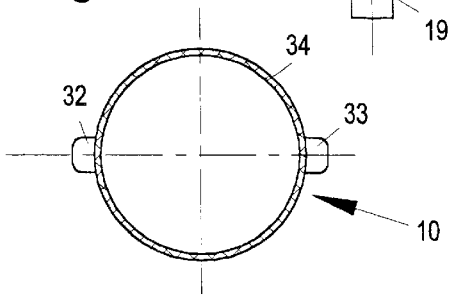
FIG. 19 is the same sectional view as FIG. 18, but with a lip of a different shape.

To close these ventilating openings 30 and 31, the cylindrical wall section 11 of the hollow body 10, which also comprises the closing member 8 and the membrane wall 9 in one piece, is provided either with two diametrically opposed, tongue-like lips 32 and 33 according to FIG. 19, or with a ring lip 34 according to FIGS. 17 and 18, which lie flat on the bottom surface 36 (FIG. 4) of the annular groove 17.

In the embodiment according to FIGS. 1 through 11, incl., the annular groove 11 of the hollow body 10 is provided at its lower edge with a truncated cone-shaped, radially projecting ring lip 35. This ring lip 35 does not lie on the flat bottom surface 36 of the annular groove 17. Instead, it lies with its outer edge 37 on the inner surface of the second ring wall 16 in an elastically sealing manner in order to thus assume the function of a one-way ventilating valve, which closes the access to the ventilating openings 30 and 31 in the case of overpressure and permits the flow of atmospheric air from the ventilating channels 28 and 29 into the hollow space 27 surrounding the hollow body 10 in the case of vacuum. The lips 32 and 33 as well as the ring lip 34 also function, in principle, in the same manner. The only difference is that these lips 32 and 33 and the ring lip 34 assume their closing function by lying flat on the flat bottom surface of the annular groove 17.

It can be recognized from FIGS. 1, 2, 7, 13, 14 and 16 that the ventilating channels 28 and 29 end within the inner ring wall 12 in the chamber 15, so that the chamber 15 is continuously in connection with the atmosphere and the volume of the chamber 15 can change during the opening and closing movements of the closing member 8 without a change in pressure.

As is apparent from FIGS. 1 through 7, the hood cover 4 has, on the inner side of its front wall 3, a sealing ring 40, which is sealingly in contact with the inner surface of the ring wall 22 of the housing 23 and likewise has the shape of a conical ring lip.

The ring wall 16 of the housing 23 is surrounded by a ring-shaped closing wall 42 of the hood cover 4.

Both the ring wall 16 of the housing 23 and the closing wall 42 of the hood cover 4 have sector-like perforations 45 and 46 as well as 47 and 48, respectively, which can be caused to overlap one another on the housing 23 by corresponding rotary movements of the hood cover 4 around the common axis 7 in order to separate the hollow space 27 surrounded by the ring wall 16 from the ring chamber 44 located between the ring wall 22 of the housing 23 and the closing wall 42 or to connect the hollow space 27 to the ring chamber 44 as desired.

By means of the rotatable mounting of the hood cover 4 on the housing 23 and the perforations 45 through 48 in the two cylindrical walls 16 and 42, which tightly or sealingly surrounding one another, it is possible to achieve an additional separation of the contents of the container from the hollow space 27 which is in connection with the dispensing opening 5, which represents an additional safety against the medium running out in an unintended manner.

In a concentric arrangement relative to the two ring walls 11 and 16 which are concentric to one another, the hood cover 4 is mounted for this purpose on the housing 23 rotatably around the housing axis, which coincides with the axis 7 of the dispensing opening 5.

The angle β of the hood cover 4 is limited by correspondingly arranged rotation limiters 50 and 51 (FIGS. 1, 3, 4 and 5) to a value that is greater than the opening angle a (FIGS. 3 and 5) of the two perforations 47 and 48 of the ring wall 16, and it may be assumed that the perforations 45 and 46 of the closing wall 42 also have at least approximately the same opening angle.

The opening angle αis advantageously about 50° and the maximum angle of rotation β is about 90°.

The rotation limiters 50 and 51 comprise inwardly projecting stop ribs, which engage respective sector-like annular grooves 52 and 53 of the ring wall 22 of the housing 23. These annular grooves extend over the centering angle β, which permits a rotary movement of the hood cover 4 on the housing 23 by about 90°.

Figure 2:
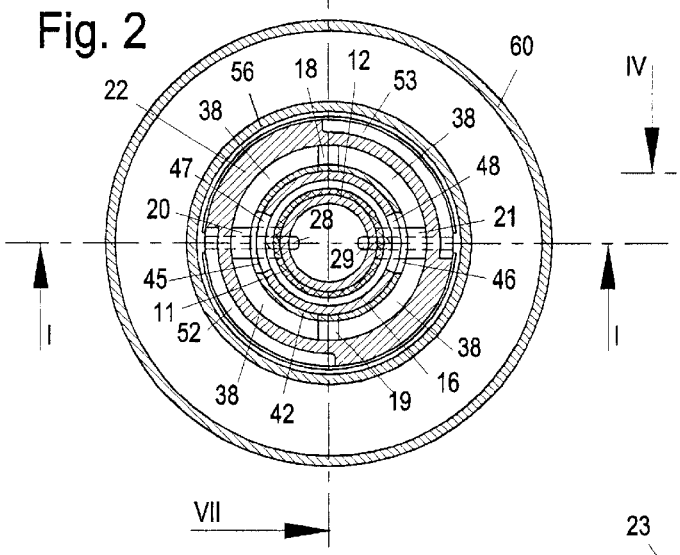
FIG. 2 is a sectional view according to line II—II from FIG. 1.
Figure 5:
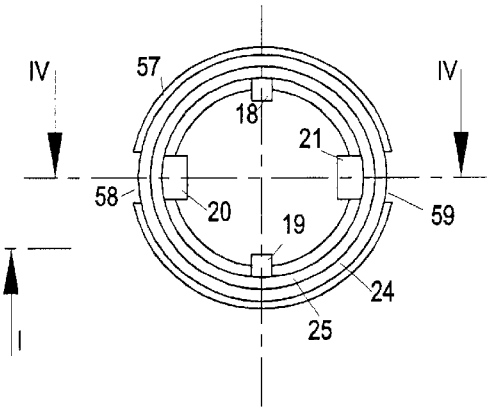
FIG. 5 is the lower front view V from FIG. 4.
Figure 3:
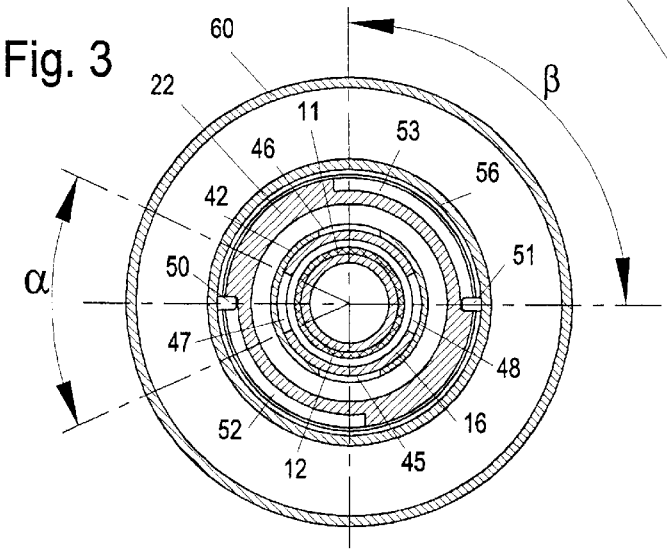
FIG. 3 is a sectional view according to line III—III from FIG. 1.

As can be recognized most clearly from FIGS. 1 and 3 as well as 7 and 8, the rotation limiters 50 and 51 are arranged on the inner side of a cylindrical coupling wall 56, which is made in one piece on the inner side of the front wall 3 of the hood cover 4 concentrically to the common axis 7. This coupling wall 56 is provided at its lower edge with a radially inner, ring-like locking cam 49, which is circularly closed in itself in the embodiment shown in FIGS. 1 through 3 and lockingly extends under a radially projecting ring collar 57 of the housing 23.

To provide a trouble-free connection between the ventilating channels 28 and 29 ending within this coupling wall 56 and the outside atmosphere, the ring collar 57 is interrupted by corresponding openings 58 and 59 (FIGS. 4 and 5) in at least one area, preferably in two diametrically opposed areas.

Instead of these openings 58 and 59 on the ring collar 57, the coupling wall 56 may also be provided according to FIGS. 7 through 12 with slot-like openings 54 and/or 55. The ring collar 57 may be circularly closed in itself in this case.

The ring-like outer wall 60 of the hood cover 4 may be made slightly conical or cylindrical. As is apparent from FIGS. 1 and 7, the front wall 3 of the hood cover 4 has a concave shape.

Since the mode of operation of the closing member 8 is sufficiently known from the state of the art, it is not necessary to describe it here.

Figure 8:
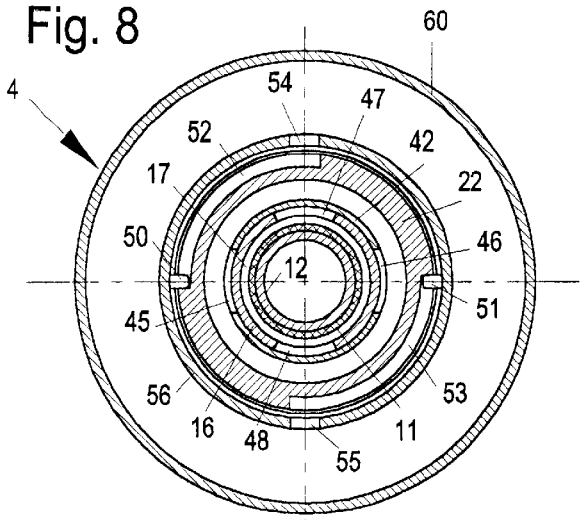
FIG. 8 is a sectional view according to line VIII—VIII from FIG. 7.
Figure 10:
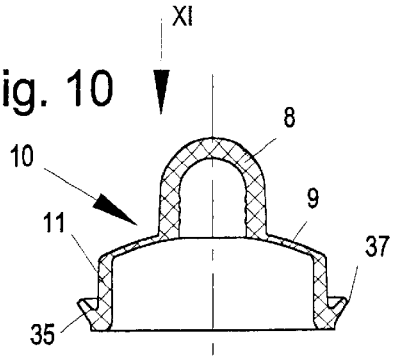
FIG. 10 is a sectional view showing the hood-like hollow body comprising the closing member and the elastic membrane wall as an individual part.

The closed position of the hood cover 4 is shown in FIGS. 3 and 8. It can be recognized that the perforations 45 and 46 of the closing wall 42 are offset by 90° in relation to the perforations 47 and 48 of the ring wall 16.

Figure 9:
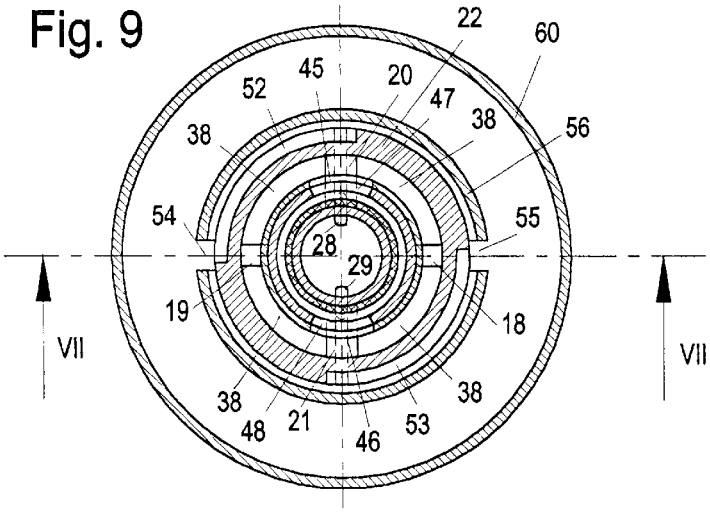
FIG. 9 is a sectional view according to line IX—IX from FIG. 7.
Figure 12:
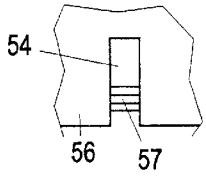
FIG. 12 is a partial view XII—XII from FIG. 8.

By contrast, FIGS. 2 and 9 show the rotated position of the hood cover 4, in which the perforations 45 and 46 of the closing wall 42 overlap the perforations 47 and 48 of the ring wall 16, so that the hollow space 27 is in connection with the annular chamber 44 and the medium can reach the annular chamber 44 and from there the hollow space 27 from the container, not shown, through the dispensing neck 2 and the sector-like passage openings 38 located between the radial webs 18 through 21. If a corresponding overpressure, which moves the closing member 8 out of the dispensing opening 5 in the downward direction, is built up, the medium can be dispensed from the hollow space 27 through the dispensing opening 5.

While this overpressure is present, the ventilating openings 30 and 31 of the annular groove 17 are either separated by the lips 32 and 33 or the ring lip 34 or, in the embodiment according to FIGS. 1 through 11, they are separated from the hollow space 27 by the ring lip 35.

Outside air is drawn into both the chamber 15 and the annular groove 17 through the ventilating channels 28 and 29 only when the manually indented container wall again returns into its starting position. This ventilation of both the chamber 15 and the annular groove 17 makes possible the rapid closing of the dispensing opening 5 by the closing member 8, on the one hand, and also the rapid return of the container wall into the normal position.

While specific embodiments of the invention have been shown and described in detail to illustrate the application of the principles of the invention, it will be understood that the invention may be embodied otherwise without departing from such principles.

What is claimed is:

1. An automatic closure for an elastically deformable container having a dispensing neck for pasty or liquid media, comprising:

a housing for attachment to the dispensing neck;

a hood cover with a front wall defining a dispensing opening;

a stopper closing member movable in the axial direction for closing an inside of the dispensing opening, the hood cover being arranged on said housing, said closing member comprising an elastic membrane wall with a hollow body of an elastic material as a whole and includes a substantially cylindrical wall section;

an inner ring wall section with a chamber which is closed by a bottom surface, said substantially cylindrical wall section surrounding said inner ring wall section, said chamber being arranged within a hollow space of the housing, though which hollow space the media flows, and said chamber being connected to the environment through at least one ventilating channel, said at least one ventilating channel being arranged in a radial web, said radial web and connecting said inner ring wall to said housing;

a second ring wall, said inner ring wall being surrounded by said second ring wall to form an annular groove with the inner ring wall, said annular groove having at least one axial ventilating opening connecting said ventilating charmel to said hollow space surrounded by said second ring wall, said substantially cylindrical wall section of said hollow body having an elastic lip separating said at least one ventilating opening from the hollow space, functioning as a on-way valve.

2. A closure in accordance with claim 1, wherein the elastic lip is a circular ring lip lying sealingly on said bottom surface of said annular groove in both an inoperative state and under overpressure and allows air to flow into the hollow space under vacuum in the hollow space.

3. A closure in accordance with claim 1, wherein the elastic lip is a ring lip projecting to the outside and engaging sealingly on said second ring wall in both an inoperative state and under overpressure in the bellow space and allows air to flow into the hollow space under vacuum in the hollow space.

4. A closure in accordance with claim 2, wherein said second ring wall having openings provided axially outside the ring lip, said openings providing a connection between the hollow space surrounding said ring lip and a ring chamber, said ring chamber surrounding said second ring wall, said ring chamber being in connection wit the interior space of a connection pipe that can be attached to the dispensing neck of the container.

5. A closure in accordance with claim 3, wherein said second ring wall having openings provided axially outside the ring lip, said openings providing a connection between the hollow space surrounding said ring lip and a ring chamber, said ring chamber surrounding said second ring wall, said ring chamber being in connection with the interior space of a connection pipe that can be attached to the dispensing neck of the container.

6. A closure in accordance with claim 4, wherein said hood cover is mounted on said housing rotatably around a common axis in a concentric arrangement in relation to the two ring walls, the two ring walls being concentric to one another, said hood cover having a ring-shaped closing wall sealingly surrounding the second ring wall and having said openings, which can be brought into an overlapping position with the openings of the second ring wall by rotating the hood cover in order to connect the ring chamber with the hollow space within the second ring wall or to separate the ring chamber from the hollow space as desired.

7. A closure in accordance with claim 6, wherein an angle of rotation of the hood cover is limited by correspondingly arranged rotation limiters to a value ($\beta$) that is greater than the opening angle ($\alpha$) of the opening of the second ring wall, which is the largest opening in the circumferential direction.

8. A closure in accordance with claim 6, wherein said hood cover is provided with a sealing ring lying sealingly on the inner surface of a cylindrical housing wall of said housing.

9. A closure in accordance with claim 7, wherein said hood cover is fastened to said housing by a cylindrical coupling wall or by ring sector coupling wall elements having radially inter-locking cams and extending with said cams under a radially projecting ring collar of said housing.

* * * * *